United States Patent [19]

McKenzie et al.

[11] Patent Number: 4,931,110

[45] **Date of Patent: * Jun. 5, 1990**

[54] EMULSION EXPLOSIVES CONTAINING A POLYMERIC EMULSIFIER

[75] Inventors: Lee F. McKenzie, Riverton; Lawrence D. Lawrence, Sandy, both of Utah

[73] Assignee: IRECO Incorporated, Salt Lake City, Utah

[ * ] Notice: The portion of the term of this patent subsequent to Apr. 11, 2006 has been disclaimed.

[21] Appl. No.: 318,768

[22] Filed: Mar. 3, 1989

[51] Int. Cl.[5] ..... C06B 45/00

[52] U.S. Cl. ..... 149/2; 149/46; 149/61; 149/83

[58] Field of Search ..... 149/2, 44, 46, 60, 61, 149/83

[56] References Cited

U.S. PATENT DOCUMENTS

| | | | |
|---|---|---|---|
| 4,357,184 | 11/1982 | Binet et al. | 149/2 |
| 4,710,248 | 12/1987 | Yates et al. | 149/21 |
| 4,784,706 | 11/1988 | McKenzie | 149/2 |
| 4,818,309 | 4/1989 | Yabsley et al. | 149/2 |
| 4,820,361 | 4/1989 | McKenzie et al. | 149/2 |
| 4,822,433 | 4/1989 | Cooper et al. | 149/2 |
| 4,828,633 | 5/1989 | Forsberg | 149/2 |

FOREIGN PATENT DOCUMENTS

| | | |
|---|---|---|
| 01555800 | 9/1985 | European Pat. Off. . |
| WO8803522 | 5/1988 | PCT Int'l Appl. . |

*Primary Examiner*—Edward A. Miller

[57] ABSTRACT

Water-in-oil emulsion explosive compositions have improved detonation properties, stability and lower viscosity. Bis (alkanolamine or polyol) amide and/or ester derivatives of bis-carboxylated or anhydride derivatized addition polymers are used as the emulsifier. For example, alkanolamine reacted (2:1 ratio) with polyisobutenyl succinic anhydride is found superior to the corresponding 1:1 derivative.

12 Claims, No Drawings

EMULSION EXPLOSIVES CONTAINING A POLYMERIC EMULSIFIER

The present invention relates to an improved explosive composition. More particularly, the invention relates to water-in-oil emulsion explosives or emulsion components of explosives having improved detonation properties, stability and a lower viscosity. The term "water-in-oil" means a dispersion of droplets of an aqueous solution or water-miscible melt (the discontinuous phase) in an oil or water-immiscible organic substance (the continuous phase). The term "explosive" means both cap-sensitive explosives and noncap-sensitive explosives commonly referred to as blasting agents. The water-in-oil emulsion explosives of this invention contain a water-immiscible organic fuel as the continuous phase and an emulsified inorganic oxidizer salt solution or melt as the discontinuous phase. (The terms "solution" or "melt" hereafter shall be used interchangeably.) These oxidizer and fuel phases react with one another upon initiation by a blasting cap and/or a booster to produce an effective detonation.

The explosives contain an emulsifier that is a bis-alkanolamine or bis-polyol derivative of a bis-carboxylated or anhydride derivatized olefinic or vinyl addition polymer, the said addition polymer having an average chain length of from about 10 to about 32 carbon atoms (excluding side chains or branching) and preferably from about 15 to about 27 carbon atoms.

The emulsifiers of this invention impart surprisingly improved stability and detonation properties to the explosive over those obtained with conventional emulsifiers or similar emulsifiers of higher chain lengths, or analogous mono-alkanolamine or mono-polyol derivatives. A bis-carboxylated or acid anhydride derivative of olefinic or vinyl addition polymers has the potential of forming two ester groups when reacted with an alcohol or two amide groups when reacted with an amine. Bis- derivatives involve the formation of amide or ester groups on both carboxyl sites, and mono- derivatives involve the formation of an amide or ester group on only one carboxyl site, leaving the second site as a carboxylic acid or carboxylate anion. Under certain conditions a single amine group can react with both carboxyl groups to form an imide, which can be considered a mono- derivative.

BACKGROUND OF THE INVENTION

Water-in-oil emulsion explosives are well-known in the art. See, for example, U.S. Pat. Nos. 4,356,044; 4,322,258; 4,141,767; 3,447,978 and 3,161,551. Emulsion explosives are found to have certain advantages over conventional aqueous slurry explosives, which have a continuous aqueous phase, as described in U.S. Pat. No. 4,141,767.

An inherent problem with emulsion explosives, however, is their relative instability, due to the fact that they comprise a thermodynamically unstable dispersion of supercooled solution or melt droplets in an oil-continuous phase. If the emulsion remains stable, these supercooled droplets are prevented from crystallizing or solidifying into a lower energy state. If the emulsion weakens or becomes unstable, however, then crystallization or solidification of the droplets results, and the explosive generally loses at least some of its sensitivity to detonation and becomes too viscous to handle for certain blasting applications. Moreover, it is common to add solid components to emulsion explosives, such as glass microspheres for density reduction and prills or particles of oxidizer salt such as porous prilled ammonium nitrate (AN) for increased energy. These solid components, however, tend to destabilize emulsions.

Emulsion explosives commonly are used as a repumpable explosive, i.e., an explosive that is formulated at a remote facility, loaded or pumped into a bulk container and then transported in the container to a blasting site where it then is "repumped" from the container into a borehole. Alternatively, the explosive may be delivered (repumped) into a centrally located storage tank from which it will be further repumped into a vehicle for transportation to a blasting site and then again repumped into the borehole. Thus the emulsion explosive must remain stable even after being subjected to repeated handling or shearing action, which normally also tends to destabilize an emulsion. Additionally, the emulsion's viscosity must remain low enough to allow for repumping at reasonable pressures and at the low ambient temperatures that may be experienced during colder months. Repeated handling or shearing action also tends to increase the emulsion's viscosity.

Since a density control agent is required in many instances to reduce the density of an explosive and thereby increase its sensitivity to a required level for detonation, and since hollow microspheres are a preferred form of density control, it is important that the emulsion remain stable and have a low viscosity even when containing solid density control agents.

U.S. Pat. No. 4,708,753 discloses water-in-oil emulsions containing as the emulsifier a salt derived from a hydrocarbyl-substituted carboxylic acid or anhydride, or ester or amide derivative thereof, and an amine. The bis-substituted derivative, nonionic emulsifiers of the present invention differ from these prior art emulsifiers which are anionic mono-substituted derivatives.

U.S. Pat. No. 4,615,751 discloses the use of an unspecified polybutenyl succinic anhydride derivative (with a tradename of EXPERSE 60) as a water-resisting agent in emulsions containing prills but not as an emulsifier. European Patent Application No. 0 155 800 discloses alkanolamine derivatives of polyisobutenyl succinic anhydride as emulsifiers but the examples all contain mono-derivatives, the vast majority of which have higher chain lengths than those of the present invention. In fact, 1:1 alkanolamine:polyisobutenyl succinic anhydride derivatives are easier to prepare than 2:1 derivatives of the present invention. The teachings in the European Patent Application No. 0 155 800 gravitate toward in-situ emulsifier formation under mild conditions where 1:1 rather than 2:1 derivatives of hydrophobic moities and polyisobutenyl succinic anhydride are favored.

U.S. Pat. No. 4,710,248 discloses water-in-oil emulsion explosives containing as an emulsifier underivatized polyisobutenyl succinic anhydride or polyisobutenyl succinic acid, which differ from the bis- derivatives of the present invention by the lack of substitution on the carboxylate functionality.

U.S. Pat. No. 4,357,184 discloses water-in-oil emulsions containing graft block or branched polymer emulsifiers. One type of block copolymer which is taught contains polyisobutenyl succinic anhydride as the hydrophobic block and polyethylene glycol or polyethylenimine as the hydrophilic block. Block copolymers are clearly distinguishable from the present invention, which involves derivatization of bis carboxylated olefinic or vinyl addition polymers by non-polymeric alkanolamines or polyols. Furthermore, the olefinic chain of the disclosed block copolymer is specified as being from 40 to 500 carbon atoms which is much longer than the chain length of the present invention.

International Publication No. (PCT) WO 88 03522 discloses a polyamine derivative of polyisobutenyl succinic anhydride as an emulsifier, which differs from the monomeric bis- derivatives of the present invention.

As more fully set forth below, the alkanolamine or polyol, nonionic, bis- derivative emulsifier of the present invention offers distinct advantages over all of these prior art emulsifiers.

SUMMARY OF THE INVENTION

The invention relates to a water-in-oil emulsion explosive comprising an organic fuel as a continuous phase; an emulsified inorganic oxidizer salt solution as a discontinuous phase; optionally, a density reducing agent and an emulsifier which is a bis-alkanolamine or bis polyol derivative of a bis-carboxylated olefinic or vinyl addition polymer in which the addition polymer chain has an average chain length of from about 10 to about 32 carbon atoms (excluding branches or side chains) and preferably from about 15 to about 27 carbon atoms. It is found that the bis- derivative emulsifier of the specified chain length range imparts enhanced stability to the explosive composition and superior detonation results due, at least in part, to degree of refinement and small oxidizer solution droplet sizes. This emulsifier is also advantageous in small diameter, cap-sensitive explosive compositions containing relatively low amounts of water, i.e., from about 0% to 5%. In such low water compositions, the emulsifier imparts significant low-temperature stability advantages over conventional emulsifiers. In addition, the emulsifier provides surprisingly improved emulsion stability in the presence of ammonium nitrate prills. Further, detonation properties are greatly improved as compared to the use of higher chain length emulsifiers or analogous mono-substituted alkanolamine or polyol derivatives.

DETAILED DESCRIPTION OF THE INVENTION

The immiscible organic fuel forming the continuous phase of the composition is present in an amount of from about 3% to about 12%, and preferably in an amount of from about 4% to about 8% by weight of the composition. The actual amount used can be varied depending upon the particular immiscible fuel(s) used and upon the presence of other fuels, if any. The immiscible organic fuels can be aliphatic, alicyclic, and/or aromatic and can be saturated and/or unsaturated, so long as they are liquid at the formulation temperature. Preferred fuels include tall oil, mineral oil, waxes, paraffin oils, benzene, toluene, xylenes, mixtures of liquid hydrocarbons generally referred to as petroleum distillates such as gasoline, kerosene and diesel fuels, and vegetable oils such as corn oil, cottonseed oil, peanut oil, and soybean oil. Particularly preferred liquid fuels are mineral oil, No. 2 fuel oil, paraffin waxes, microcrystalline waxes, and mixtures thereof. Aliphatic and aromatic nitro-compounds and chlorinated hydrocarbons also can be used. Mixtures of any of the above can be used.

Optionally, and in addition to the immiscible liquid organic fuel, solid or other liquid fuels or both can be employed in selected amounts. Examples of solid fuels which can be used are finely divided aluminum particles; finely divided carbonaceous materials such as gilsonite or coal; finely divided vegetable grain such as wheat; and sulfur. Miscible liquid fuels, also functioning as liquid extenders, are listed below. These additional solid and/or liquid fuels can be added generally in amounts ranging up to 15% by weight. If desired, undissolved oxidizer salt can be added to the composition along with any solid or liquid fuels.

The inorganic oxidizer salt solution forming the discontinuous phase of the explosive generally comprises inorganic oxidizer salt, in an amount from about 45% to about 95% by weight of the total composition, and water and/or water-miscible organic liquids, in an amount of from about 0% to about 30%. The oxidizer salt preferably is primarily ammonium nitrate, but other salts may be used in amounts up to about 50%. The other oxidizer salts are selected from the group consisting of ammonium, alkali and alkaline earth metal nitrates, chlorates and perchlorates. Of these, sodium nitrate (SN) and calcium nitrate (CN) are preferred. From about 10% to about 65% of the total oxidizer salt may be added in particle or prill form. For example, AN prills or ANFO can be combined with and mixed into the emulsion. A particular advantage of the present invention is improved emulsion stability in the presence of such prills.

Water generally is employed in an amount of from 0% to about 30% by weight based on the total composition. It is commonly employed in emulsions in an amount of from about 10% to about 20%. Another particular advantage of the present invention is enhanced emulsion stability in low water formulations, i.e., those containing from 0% to less than 5% water. Formulations with lower water generally are more efficient, e.g., they have higher energies and detonation temperatures and are more sensitive. Since lower water increases the thermodynamic instability of an emulsion (because the crystallization temperature of the oxidizer salt solution is higher), maintaining stability in low water formulations heretofore has been a problem.

Water-miscible organic liquids can at least partially replace water as a solvent for the salts, and such liquids also function as a fuel for the composition. Moreover, certain organic compounds reduce the crystallization temperature of the oxidizer salts in solution. Miscible solid or liquid fuels can include alcohols such as sugars and methyl alcohol, glycols such as ethylene glycols, amides such as formamide, urea and analogous nitrogen-containing fuels. As is well known in the art, the amount and type of water-miscible liquid(s) or solid(s) used can vary according to desired physical properties.

The emulsifiers of the present invention are bis-alkanolamine or bis-polyol derivatives of bis-carboxylated or anhydride derivatized olefinic or vinyl addition polymers, in which the addition polymer chain that forms the hydrophobic region(s) of the emulsifier molecule has a backbone carbon chain length (excluding branching) of from about 10 to about 32 carbon atoms, and preferably from about 16 to about 32 carbon atoms. They preferably are used in an amount of from about 0.2% to about 5%. Also included within the invention are mixtures of emulsifiers of varying chain lengths, provided the average of the chain lengths is within the above-cited range.

The olefinic or vinyl addition polymers which are precursors to the emulsifiers may be derived from any of a number of olefinic monomers including but not limited to ethylene, propene, 1-butene, 2-butene, 2-methylpropene chloroethylene, butadiene and alpha olefins of $C_4$ through $C_{18}$. The olefinic monomers may be used singly or in combination. However, the average chain length of the olefinic or vinyl addition polymer (excluding branching or side chains) should be within the range of 10 to 32 carbon atoms. The olefinic or vinyl addition polymers are conveniently bis-carboxylated or converted to an acid anhydride derivative by reaction with such materials as maleic anhydride, maleic acid, tetrahydrophthalic anhydride, mesaconic acid, glutaconic acid, sorbic acid, itaconic acid, itaconic anhydride and the like. In the case of addition polymers with mono-olefins as monomers, a terminal olefinic bond is available on the addition polymers for an "ene" reaction which attaches a bis-carboxylated olefin to the polymer. In those cases where bis-olefins such as butadiene are used to prepare the addition polymer, multiple olefinic groups are present along the polymer chain. In such cases, bis-carboxylated olefins may be attached randomly along the polymer chain. Thus such polymers as "maleinized polybutadiene" can act as precursors to the bis-alkanolamine or bis-polyol derivatives of this invention.

Bis-carboxylated olefinic or vinyl addition polymers can be reacted with amines or alcohols to form the corresponding bis-amide, bis-ester or mixed amide/ester derivatives. In order to assure the formation of bis- rather than mono- derivatives, a two molar ratio of amine or alcohol relative to bis-carboxylated olefinic or vinyl addition polymer is required. The formation of an amide or ester functionality from the precursor carboxylic acids and amines or alcohols is generally accomplished by heating and removing water of reaction. A somewhat more facile approach to obtaining the bis-amide or bis-ester derivatives is to react the amines or alcohols with an acid anhydride derivative of the olefinic or vinyl addition polymer. One mole of the alcohol or amine reacts readily under mild conditions with the acid anhydride derivative to produce a mixed carboxylic acid/amide or ester derivative (mono- derivative). The reaction of the remaining carboxylic acid group with a second mole of amine or alcohol requires energy or heat to eliminate one mole of water. The resulting bis ester, bis amide or mixed ester/amide derivative is the polymeric emulsifier(s) of this invention.

Depending upon the ratio of reactants and reaction conditions, mixed derivatives are possible. For example, if a polyolefin derivative with maleic anhydride is reacted at lower temperatures with one molar equivalent of ethanolamine, ring opening of the anhydride occurs with the formation of amide and ester functional groups. Further heating of the product can be done to remove one equivalent of water to convert amide derivatives to imides. If, however, two equivalents of ethanolamine are reacted with the polyolefin derivative with maleic anhydride with sufficient heat to remove water, bis-amide, bis-ester, mixed amide/ester and imide products are possible.

The emulsifiers of the present invention can be used singly, in various combinations or in combination(s) with conventional emulsifiers such as sorbitan fatty esters, glycol esters, carboxylic acid salts, substituted oxazolines, alkyl amines or their salts, derivatives thereof and the like.

The compositions of the present invention are reduced from their natural densities by addition of a density reducing agent in an amount sufficient to reduce the density to within the range of from about 0.9 to about 1.5 g/cc. Density reducing agents that may be used include glass and organic microspheres, perlite and chemical gassing agents, such as sodium nitrite, which decompose chemically in the composition to produce gas bubbles.

One of the main advantages of a water-in-oil explosive over continuous aqueous phase slurry is that thickening and cross-linking agents are not necessary for stability and water resistancy. However, such agents can be added if desired. The aqueous solution of the composition can be rendered viscous by the addition of one or more thickening agents and cross-linking agents of the type commonly employed in the art.

Rheological properties of compositions of the present invention may be altered by the addition of various oil soluble crosslinking agents as are known in the art. In such cases, the formulations are said to have crosslinked fuel phases.

The explosives of the present invention may be formulated in a conventional manner. Typically, the oxidizer salt(s) first is dissolved in the water (or aqueous solution of water and miscible liquid fuel) or melted at an elevated temperature of from about 25° C. to about 90° C. or higher, depending upon the crystallization temperature of the salt solution. The aqueous or melt solution then is added to a solution of the emulsifier and the immiscible liquid organic fuel, which solutions preferably are at the same elevated temperature, and the resulting mixture is stirred with sufficient vigor to produce an emulsion of the aqueous or melt solution in a continuous liquid hydrocarbon fuel phase. Usually this can be accomplished essentially instantaneously with rapid stirring. (The compositions also can be prepared by adding the liquid organic to the aqueous solution.) The solid ingredients, including any solid density control agent, then are added and stirred throughout the formulation by conventional means. The formulation process also can be accomplished in a continuous manner as is known in the art. Also, the sold density control agent may be added to one of the two liquid phases prior to emulsion formation.

It has been found to be advantageous to predissolve the emulsifier in the liquid organic fuel prior to adding the organic fuel to the aqueous solution. This method allows the emulsion to form quickly and with minimum agitation. However, the emulsifier may be added separately as a third component if desired.

Sensitivity and stability of the compositions may be improved slightly by passing them through a high-shear system to break the dispersed phase into even smaller droplets prior to adding the density control agent.

Reference to the following Tables further illustrate the invention.

Mixes 1–10 in Table I illustrate the effect of changing the molecular weight of the precursor polyisobutylene (PIB). Included in the Table are formulations for emulsions without solid admixtures (mixes 1–5) and emulsions containing 30% ANFO (mixes 6–10). The emulsifiers in mixes 1–10 of Table I are all bis-derivatives (2:1) of an alkanolamine and polyisobutenyl succinic anhydride (PIBSA).

In mixes 1–5 of Table I it can be seen that as the chain length of the precursor polyisobutylene (PIB) was lowered, the average emulsion cell diameters were dramatically reduced. Generally, detonation properties are enhanced as cell diameters are lowered. Viscosities also tended to lower with the lowering of chain lengths.

Dynamic emulsion stability was determined by periodic stressful mixing of the emulsions.

Mixes 6–10 in Table I illustrate that improved emulsion/ANFO stability is obtained when the bis- (i.e., 2:1) alkanolamine PIBSA derivative has a precursor polyolefin average chain length within the claimed range.

Mixes 11 and 12 in Table 1 illustrate the superiority of 2:1 alkanolamine/PIBSA derivatives over corresponding 1:1 derivatives. The emulsifier in mix 11 was a 1:1 derivative, while that of mix 12 was the corresponding 2:1 derivative.

Table II illustrates the improved detonation properties obtained with polyisobutylene (PIB) precursors falling within the chain length range of the present invention. Mix 1 was prepared using an emulsifier which had an average precursor PIB chain length of 33 carbons, and in mix 2 the average precursor PIB carbon chain length was 20. The detonation velocity increased from 5080 m/sec in mix 1 to 5520 m/sec in mix 2 when the lower molecular weight emulsifier was used. Mixes 3 and 4 correspond respectively to mixes 1 and 2 except that 30% ANFO was added to the emulsions. Not only was the detonation velocity higher with the shorter chain length emulsifier (mix 4), but also the minimum booster and critical diameter were reduced.

Table III shows the improved storage stability provided by an emulsifier of the invention (mix 2) compared to a conventional emulsifier in mix 1.

The compositions of the present invention can be used in the conventional manner. The compositions normally are loaded directly into boreholes as a bulk product although they can be packaged, such as in cylindrical sausage form or in large diameter shot bags. Thus the compositions can be used both as a bulk and a packaged product. The compositions generally are extrudable and/or pumpable with conventional equipment. The above-described properties of the compositions render them versatile and economically advantageous for many applications.

While the present invention has been described with reference to certain illustrative examples and preferred embodiments, various modifications will be apparent to those skilled in the art and any such modifications are intended to be within the scope of the invention as set forth in the appended claims.

TABLE I

| | Mix Number | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Ingredients (%) | | | | | | | | | | | | |
| AN | 65.9 | 65.9 | 65.9 | 65.9 | 65.9 | 46.1 | 46.1 | 46.1 | 46.1 | 46.1 | 46.1 | 46.1 |
| CN[a] | 15.3 | 15.3 | 15.3 | 15.3 | 15.3 | 10.7 | 10.7 | 10.7 | 10.7 | 10.7 | 10.7 | 10.7 |
| Water | 12.8 | 12.8 | 12.8 | 12.8 | 12.8 | 8.98 | 8.98 | 8.98 | 8.98 | 8.98 | 8.98 | 8.98 |
| #2 Fuel Oil | 4.18 | 4.18 | 4.18 | 4.18 | 4.18 | 2.95 | 2.95 | 2.95 | 2.95 | 2.95 | 2.95 | 2.95 |
| Mineral Oil | 1.20 | 1.20 | 1.20 | 1.20 | 1.20 | 0.84 | 0.84 | 0.84 | 0.84 | 0.84 | 0.84 | 0.84 |
| Emulsifier[b] | 0.62 | 0.62 | 0.62 | 0.62 | 0.62 | 0.43 | 0.43 | 0.43 | 0.43 | 0.43 | | |
| Emulsifier[c] | | | | | | | | | | | 0.43 | |
| Emulsifier[d] | | | | | | | | | | | | 0.43 |
| ANFO[e] | | | | | | 30.0 | 30.0 | 30.0 | 30.0 | 30.0 | 30.0 | 30.0 |
| Average Cell Diameter[f] | 12.7 | 11.1 | 10.2 | 7.7 | 6.1 | | | | | | | |
| Emulsion Viscosity (cps) | 15,900 | 10,800 | 11,500 | 8,800 | 5,840 | | | | | | | |
| Static Stability[g] | | | | | | 0 | 1 | 2 | 5 | 2 | 0 | 8+ |
| Dynamic Stability[h] | 7 | 32+ | 32+ | 32+ | 16 | | | | | | | |
| Average PIB chain length in no. of carbons | 46 | 33 | 27 | 20 | 15 | 46 | 33 | 27 | 20 | 15 | 20 | 20 |

[a]Fertilizer grade calcium nitrate comprising 81:14:5 calcium nitrate, water and ammonium nitrate.
[b]Bis- (i.e., 2:1) derivatives of trishydroxymethylaminomethane (THAM):polyisobutenyl succinic anhydride (PIBSA).
[c]Mono- (i.e., 1:1) derivatives of monoethanolamine (MEA) and polyisobutenyl succinic anhydride (PIBSA).
[d]Bis- (i.e., 2:1) derivative of MEA and PIBSA.
[e]ANFO is 94% AN prill with 6% #2 fuel oil.
[f]Average cell diameters are given in microns.
[g]Values are reported as weeks stability at 20° C.
[h]Values are reported as weeks stability at 20° C. with periodic mixing.

TABLE II

| | Mix Number | | | |
|---|---|---|---|---|
| | 1 | 2 | 3 | 4 |
| Ingredients (%) | | | | |
| AN | 59.0 | 59.0 | 41.3 | 41.3 |
| CN[a] | 13.2 | 13.2 | 9.24 | 9.24 |
| Water | 15.8 | 15.8 | 11.1 | 11.1 |
| #2 Fuel Oil | 3.90 | 3.90 | 2.73 | 2.73 |
| Mineral Oil | 1.76 | 1.76 | 1.23 | 1.23 |
| Emulsifier[b] | 0.84 | 0.84 | 0.59 | 0.59 |
| Atomized Aluminum | 3.00 | 3.00 | 2.10 | 2.10 |
| Glass Microballoons | 2.50 | 2.50 | 1.75 | 1.75 |
| ANFO[c] | | | 30 | 30 |
| Oxidizer pH | 5.7 | 5.7 | 5.7 | 5.7 |
| Average PIB Chain Length in No. of Carbons | 33 | 20 | 33 | 20 |
| Detonation Test Results at | 5° C. | | | |
| Detonation Velocity 75 mm (m/sec) | 5080 | 5520 | | |
| Minimum Booster 75 mm, Det/Fail | 4.5 g/ #12 | 4.5 g/ #12 | | |
| Critical Diameter mm, Det/Fail | 25/— | 25/— | | |
| Detonation Velocity 100 mm (m/sec) | | | 4380 | 4700 |
| Detonation Velocity 63 mm (m/sec) | | | Fail | 4540 |
| Minimum Booster 100 mm, Det/Fail | | | 90 g/ 50 g | 50 g/ 18 g |

TABLE II-continued

| | Mix Number | | | |
|---|---|---|---|---|
| | 1 | 2 | 3 | 4 |
| Critical Diameter, Det/Fail | | | 75/63 | 50/— |

[a]Fertilizer grade calcium nitrate comprising 81:14:5 calcium nitrate, water and ammonium nitrate.
[b]Emulsifiers prepared by reacting 2:1 trishydroxymethylaminomethane:polyisobutenyl succinic anhydride.
[c]ANFO was prepared from 6% No. 2 fuel oil and 94% ammonium nitrate prill.

TABLE III

| | Mix Number | |
|---|---|---|
| | 1 | 2 |
| Ingredients | | |
| Ammonium Nitrate | 65.0 | 65.0 |
| Sodium Nitrate | 16.3 | 16.3 |
| Water | 3.55 | 3.55 |
| Urea | 4.00 | 4.00 |
| Mineral Oil | 0.52 | 0.52 |
| Amber Wax | 1.56 | 1.56 |
| Paraffin Wax | 1.56 | 1.56 |
| Emulsifier[a] | 1.56 | |
| Emulsifier[b] | | 1.56 |
| Atomized Aluminum | 3.0 | 3.0 |
| Glass Microballoons | 3.0 | 3.0 |
| Storage Stability at −20° C. | 75 | 150+ |

[a]Sorbitan fatty acid ester.
[b]2:1 THAM/PIBSA. The PIB precursor for the emulsifier had an average carbon chain length of 20.

What is claimed is:

1. A water-in-oil emulsion explosive or emulsion component of an explosive comprising an organic fuel as a continuous phase; an emulsified inorganic oxidizer salt solution or melt as a discontinuous phase; a density reducing agent and, as an emulsifier, a covalent bis-alkanolamine or bis-polyol derivative of a bis-carboxylated or anhydride derivatized olefinic or vinyl addition polymer in which the olefinic or vinyl addition polymer chain has an average chain length of from about 10 to about 32 carbon atoms, excluding side chains or branching.

2. An explosive according to claim 1 wherein the density reducing agent is present in an amount sufficient to reduce the density of the explosive to within the range of from about 1.0 to about 1.5 g/cc.

3. A claim according to claim 2 wherein the density reducing agent is selected from the group consisting of glass microspheres, organic microspheres, perlite, chemical gassing agents and mixtures thereof.

4. An explosive according to claim 1 wherein the oxidizer salt solution comprises inorganic oxidizer salt in an amount of from about 45% to about 95% by weight of the total composition and water and/or water-miscible organic liquids in an amount of from about 2% to about 30%.

5. An explosive according to claim 4 wherein the explosive is cap-sensitive and water is present in an amount of from about 2% to less than 5%.

6. An explosive according to claim 1 wherein the emulsifier is present in an amount of from about 0.2% to about 5%.

7. An explosive according to claim 1 wherein the bis-derivative is selected from the group consisting cf oxazolines, amides, esters, amines, alcohols and mixtures thereof.

8. An explosive according to claim 1 wherein the emulsifier is a bis-ester or bis-amide derivative of polyisobutenyl succinic anhydride and trishydroxymethylaminomethane.

9. A blasting agent according to claim 1 wherein the organic fuel is selected from the group consisting of tall oil, mineral oil, waxes, benzene, toluene, xylene, petroleum distillates such as gasoline, kerosene, and diesel fuels, and vegetable oils such as corn oil, cottonseed oil, peanut oil and soybean oil.

10. An explosive according to claim 1 wherein the inorganic oxidizer salt is selected from the group consisting of ammonium and alkali and alkaline earth metal nitrates, chlorates and perchlorates and mixtures thereof.

11. An explosive according to claim 1 wherein the emulsifier has an average chain length of from about 15 to about 27 carbon atoms, excluding side chains or branching.

12. A water-in-oil emulsion explosive comprising a water-immiscible organic fuel as a continuous phase in an amount of from about 3% to about 12% by weight based on the total composition; an emulsified aqueous inorganic oxidizer salt solution as a discontinuous phase, comprising inorganic oxidizer salt in an amount of from about 45% to about 95%; water in an amount of from about 2% to about 20%; an emulsifier which is a covalent bis-polyol or bis-alkanolamine derivative of a bis-carboxylated or anhydride derivatized olefinic or vinyl addition polymer in which the addition polymer has an average chain length of from about 10 to about 32 carbon atoms, excluding side chains or branching; and a density reducing agent in an amount sufficient to reduce the density of the explosive to within the range from about 1.0 to about 1.5 g/cc.

* * * * *